US012782078B2

(12) United States Patent
White

(10) Patent No.: US 12,782,078 B2
(45) Date of Patent: Nov. 3, 2026

(54) MOBILE LONG-RANGE ARTILLERY SYSTEM

(71) Applicant: Mark G. White, Georgetown, TX (US)

(72) Inventor: Mark G. White, Georgetown, TX (US)

( * ) Notice: Subject to any disclaimer, the term of this patent is extended or adjusted under 35 U.S.C. 154(b) by 0 days.

(21) Appl. No.: 19/425,462

(22) Filed: Dec. 18, 2025

(65) Prior Publication Data

US 2026/0210661 A1 Jul. 23, 2026

Related U.S. Application Data

(60) Provisional application No. 63/748,499, filed on Jan. 23, 2025.

(51) Int. Cl.
*F41A 23/36* (2006.01)

(52) U.S. Cl.
CPC ..... *F41A 23/36* (2013.01)

(58) Field of Classification Search
CPC ..... F41A 23/34; F41A 23/36; B62D 21/09; B60P 21/02
See application file for complete search history.

(56) References Cited

U.S. PATENT DOCUMENTS 2,520,118 A 8/1950 Conlon et al.
2,549,835 A * 4/1951 McCann ..... F41A 23/50 89/40.11
4,457,209 A 7/1984 Scheurich et al.
4,644,844 A * 2/1987 Zierler ..... B60D 1/173 89/40.08
5,924,648 A * 7/1999 Ellinthorpe ..... F41A 23/42 89/1.804

(Continued)

FOREIGN PATENT DOCUMENTS

CN 212902890 U 4/2021
DE 10342440 A1 4/2004

(Continued)

OTHER PUBLICATIONS

Dangwal, Ashish; US Confident of Deploying Long-Rand Hypersonic Weapons By 2023-End To Counter China & Russia, https://www.eurasiantimes.com/us-confident-of-deploying-long-range-hypersonic-weapons/, Oct. 10, 2023.

(Continued)

*Primary Examiner* — Joshua E Freeman
(74) *Attorney, Agent, or Firm* — HULSEY P.C.

(57) ABSTRACT

A mobile long-range artillery system integrating a tractor and a trailer having a high-capacity artillery assembly is disclosed. The artillery assembly mounts on the trailer towed by a Heavy Expanded Mobility Tactical Truck (HEMTT) tractor for rapid mobility and deployment. The mobile long-range artillery system includes a 88-caliber 155 mm cannon capable of firing ammunition up to 96 kilometers. The trailer is configurable to accommodate larger caliber cannons such as 203 mm or 240 mm for ultra-long-range capabilities i.e., more than 96 km range. Further, the cannon connects to a 20-round autoloader capable of firing eight rounds per minute. The artillery assembly includes a slidable barrel deployable from a retracted travel position to a run-out firing position. The mobile long-range artillery system offers enhanced range and firepower and provides significant advantages in military operations.

20 Claims, 4 Drawing Sheets

(56) References Cited

U.S. PATENT DOCUMENTS

| | | | | |
|---|---|---|---|---|
| 6,457,396 | B1 * | 10/2002 | Bean | F41A 23/34 89/40.01 |
| 7,357,063 | B2 * | 4/2008 | Balbo | F41A 23/32 89/40.01 |
| 8,266,999 | B1 * | 9/2012 | Sisemore | F41F 3/042 89/1.8 |
| 9,360,266 | B2 * | 6/2016 | Raczek | F41A 23/30 |
| 11,421,963 | B2 | 8/2022 | Inglefield et al. | |
| 2002/0050208 | A1 * | 5/2002 | Staiert | F41A 23/00 89/40.02 |
| 2002/0129696 | A1 * | 9/2002 | Pek | F41A 23/34 89/40.01 |
| 2004/0216597 | A1 * | 11/2004 | Kohlstedt | F41A 23/34 89/40.03 |
| 2006/0162541 | A1 * | 7/2006 | Heldmann | F41A 9/16 89/45 |
| 2007/0119296 | A1 | 5/2007 | Niv et al. | |
| 2007/0151493 | A1 | 7/2007 | Graf et al. | |
| 2010/0095831 | A1 * | 4/2010 | Dekel | F41H 7/02 89/1.815 |
| 2012/0036987 | A1 * | 2/2012 | Guruprasad | F41F 3/04 89/1.813 |
| 2014/0102286 | A1 * | 4/2014 | Dawson | F41A 21/36 89/14.3 |
| 2015/0075358 | A1 * | 3/2015 | Raczek | F41A 23/30 89/41.01 |
| 2020/0166305 | A1 * | 5/2020 | Eliasson | B62D 33/077 |

FOREIGN PATENT DOCUMENTS

| | | | |
|---|---|---|---|
| DE | 102019006566 | A1 | 3/2021 |
| WO | WO9748959 | A1 | 12/1997 |
| WO | WO2000022369 | A1 | 4/2000 |
| WO | WO2007128272 | A1 | 11/2007 |
| WO | WO2021053497 | A1 | 3/2021 |

OTHER PUBLICATIONS

Department of the Army, Weapon Systems Handbook 2020-2021, https://www.army.mil/e2/downloads/rv7/2020-2021_Weapon_Systems_Handbook.pdf, 2021.

Trevithick, Joseph; US Army Eyes Replacing Its 105mm and 155mm Towed Howitzers With One New Cannon, https://www.thedrive.com/the-war-zone/18550/us-army-eyes-replacing-its-105mm-and-155mm-towed-howitzers-with-one-new-cannon, Jun. 30, 2019.

* cited by examiner

MOBILE LONG-RANGE ARTILLERY SYSTEM

CROSS-REFERENCE TO RELATED APPLICATIONS

The present application claims benefit of U.S. Provisional Application No. 63/748,499, filed Jan. 23, 2025; which is incorporated herein in its entirety and referenced thereto.

BACKGROUND OF THE INVENTION

Field of the Invention

The present invention relates to mobile artillery systems, and in particular, relates to a mobile and long-range artillery system integrating an elongated cannon barrel and high-capacity autoloader mounted on a trailer.

Description of the Prior Art

It is known that artillery systems are used by military forces for launching ammunition far beyond the range and power of infantry firearms. The artillery systems include, but not limited to, guns, mortars, and howitzers. Existing artillery systems require specialized vehicles for their mobility and deployability.

Several mobile artillery systems have been disclosed in the past. One such example is disclosed in a German Publication No. 102019006566, entitled "Self-propelled howitzer" ("the '566 Publication"). The '566 Publication discloses a self-propelled howitzer, in particular of 203 mm caliber, whose ammunition is housed in interchangeable, left and right armored ammunition containers, each of which is mounted next to the armored box containing the weapon system and other components and on the upper carriage. The upper carriage is arranged vertically and also longitudinally movable on the lower carriage via a gear ring. The lower carriage, which is mounted on a turntable on the chassis, is rotatable. The large recoil forces are supplemented by the barrel braking and recoil device on the weapon, which are not sufficient for this, and by a further, additional braking and recoil device on the lower carriage, which helps to absorb the recoil of the upper carriage. The recoil device returns the upper carriage to its original position. Due to the very flat chassis, the two-man crew cannot be accommodated in it. It is therefore placed in an armored cabin in tandem arrangement, fixed to the side of the lower mount and in front of the armored ammunition container on the upper mount.

Another example is disclosed in a U.S. Publication No. 20070151493, entitled "Integration of a large caliber gun on a ship" ("the '493 Publication"). The '493 Publication discloses a method for integrating a large-caliber gun on a ship, including connecting a turret having an armament of a lad gun with a caliber >127 mm in a modular configuration to an adaptor plate and a shock-absorbing mounting, and installing the turret on the ship so that an existing steel structure of the ship withstands increased recoil forces from the armament.

Another example is disclosed in a U.S. Pat. No. 6,457,396, entitled "Self-propelled gun" ("the '396 Patent"). The '396 Patent discloses a self-propelled gun comprising a vehicle having a source of primary power and a gun assembly movably attached to the vehicle. The gun assembly comprises a base, a cradle pivotally mounted to the base and a barrel slidably mounted to the cradle such as to be displaceable from a first, run-out, position to a second, recoiled, position as a consequence of the barrel recoiling on firing. The gun assembly is movably mounted to the vehicle, preferably by a pivot arrangement between vehicle and base, such that in a first, "mobility", mode the gun assembly is free of any direct contact with the ground, and said barrel points in a first direction allowing said vehicle to be driven and a second, "firing", mode of operation in which the gun assembly is deployed to a firing position in which the base moves towards and into engagement with the ground. During deployment of the gun assembly, the barrel is deployable through an angle of elevation which differs from said first direction by at least ninety degrees.

Typically, the United States Army has relied on 39-caliber barrels for decades. Several nations have adopted 52-caliber barrels with a 40 kilometer (km) range as the new standard. The United States Army developed a 58-caliber barrel with a 70 km range to enhance the range but the United States Army has cancelled its XM-1299 58-caliber artillery program. Furthermore, the United States Army has adopted a 40-ton trailer for long range hypersonic weapons. With growing demand, there is a constant need for developing the artillery systems with increased range, mobility and firepower.

SUMMARY OF THE INVENTION

It is an object of the present invention to provide a mobile long-range artillery system capable of enhancing the range and firepower than the conventional artillery systems.

It is another object of the present invention to provide an artillery assembly mounted over a trailer, the artillery assembly integrating a 20-round autoloader for firing 8 rounds per minute.

It is another object of the present invention to provide a mobile long-range artillery system having a cannon capable of firing ammunition up to 96 kilometers.

It is another object of the present invention to provide a configurable trailer for accommodating larger cannons for ultra-long-range capabilities.

It is another object of the present invention to provide an improved mobile and long-range artillery system mounted on a 40-ton trailer integrating an 88-caliber 155 mm cannon capable of firing shells up to 96 kilometers.

In order to achieve one or more objectives, the present invention provides a mobile long-range artillery system that enables rapid deployment of high-capacity artillery assemblies configured for long-range military operations requiring enhanced firepower and tactical mobility. The mobile long-range artillery system is configured for use in military operations, defense applications, and strategic artillery deployment where extended range capabilities and mobile platforms are beneficial for accommodating varying operational requirements and battlefield conditions. The mobile long-range artillery system includes an 88-caliber 155 mm cannon capable of firing ammunition up to 96 kilometers.

The mobile long-range artillery system includes a tractor having a chassis frame and a tractor hitch. The tractor includes a Heavy Expanded Mobility Tactical Truck (HEMTT) configuration with a cabin positioned at the front, an engine housing containing power generation components, and a transmission system for power distribution to wheels that provide mobility across varied terrain conditions. The mobile long-range artillery system includes a trailer connected to the tractor via the tractor hitch and configured to support artillery assembly operations through a trailer frame mounted on wheels with a gooseneck section extending from the trailer frame for coupling connectivity.

The mobile long-range artillery system includes an artillery assembly mounted on the trailer and comprising an ammunition container configured as a 20-round autoloader capable of firing 8 rounds per minute. The artillery assembly includes a carriage supporting the ammunition container on the trailer and providing rotational movement up to 75 degrees and pivoting capability up to 70 degrees for elevation adjustment during targeting operations. The artillery assembly includes a cannon having a cannon tube extending from the ammunition container and a barrel extending from the cannon tube that is deployable from a retracted travel position to a run-out firing position. The barrel is configured to telescopically extend in length when deployed to the run-out firing position and retract to a reduced length when in the retracted travel position, enabling compact transport configuration while providing extended barrel length for enhanced firing range during operational deployment. The artillery assembly includes trails configured to engage the ground surface to provide stability during firing operations and absorb recoil forces generated during artillery discharge.

The mobile long-range artillery system may incorporate a container mounted on the trailer and configured to camouflage the artillery assembly positioned within the container while maintaining the external appearance of a standard commercial shipping container. The container includes exterior surfaces configured with standard shipping container features including corner castings, corrugated side panels, and identification markings that provide visual deception to observers during transport operations, enabling the artillery assembly to be effectively concealed within the container while presenting the appearance of a traditional semi-trailer truck with cargo container.

In one advantageous feature of the present subject matter, the mobile long-range artillery system provides enhanced range capabilities with proper tactical mobility that enables rapid deployment and redeployment compared to fixed artillery installations. The 88-caliber cannon configuration enables users to achieve both extended range engagement up to 96 kilometers and rapid-fire capability through the 20-round autoloader system, providing comprehensive artillery support that cannot be achieved with traditional shorter-range or stationary artillery systems.

In another advantageous feature of the present subject matter, the mobile long-range artillery system maintains configurability for accommodating larger caliber cannons such as 203 mm or 240 mm cannons for ultra-long-range capabilities exceeding 96 kilometers. The modular trailer design allows users to modify artillery capacity by changing cannon specifications and ammunition configurations within the assembled system, creating a flexible artillery platform that adapts to varying operational requirements and mission complexity.

These and other objects of the present invention will be apparent from review of the following specification and the accompanying drawings.

DETAILED DESCRIPTION OF THE PREFERRED EMBODIMENT

The detailed description set forth below in connection with the appended drawings is intended as a description of exemplary embodiments in which the presently disclosed invention may be practiced. The term "exemplary" used throughout this description means "serving as an example, instance, or illustration," and should not necessarily be construed as preferred or advantageous over other embodiments. The detailed description includes specific details for providing a thorough understanding of the presently disclosed mobile long-range artillery system. However, it will be apparent to those skilled in the art that the presently disclosed invention may be practiced without these specific details. In some instances, well-known structures and devices are shown in functional or conceptual diagram form in order to avoid obscuring the concepts of the presently disclosed mobile long-range artillery system.

In the present specification, an embodiment showing a singular component should not be considered limiting. Rather, the invention preferably encompasses other embodiments including a plurality of the same component, and vice-versa, unless explicitly stated otherwise herein. Moreover, the applicant does not intend for any term in the specification to be ascribed an uncommon or special meaning unless explicitly set forth as such. Further, the present invention encompasses present and future known equivalents to the known components referred to herein by way of illustration.

Although the present invention describes a mobile long-range artillery system, it is to be further understood that numerous changes may arise in the details of the embodiments of the mobile long-range artillery system. It is contemplated that all such changes and additional embodiments are within the spirit and true scope of this invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the invention and are not intended to limit the scope of the invention.

Various features and embodiments of a mobile long-range artillery system are explained in conjunction with the description of FIGURES (FIGS. 1-4.

Figure 1:
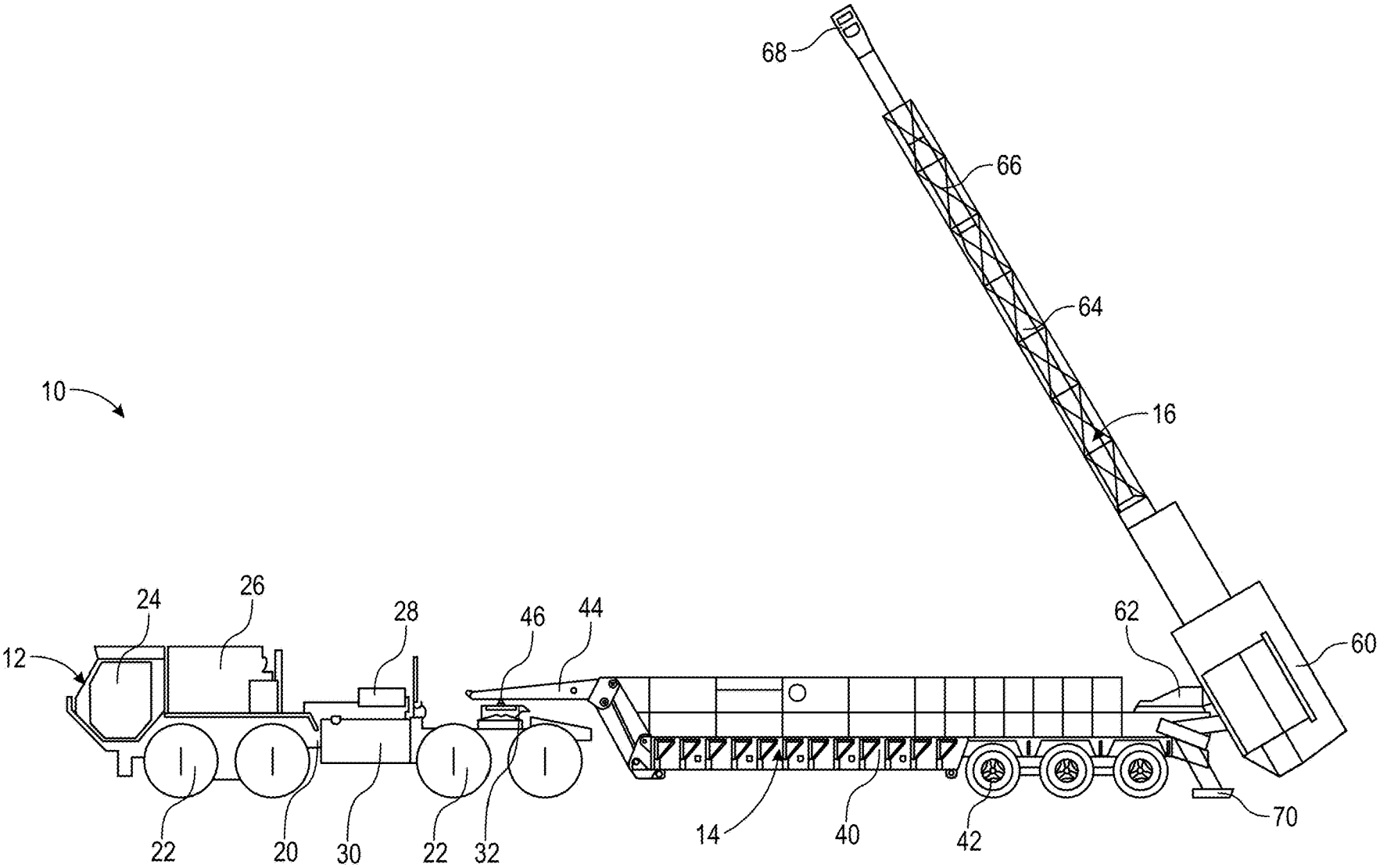
FIG. 1 is a side view of a mobile long-range artillery system in a deployed position (run out position), in accordance with one embodiment of the present invention.

FIG. 1 shows a side view of a mobile long-range artillery system 10 in deployed position (run out position), in accordance with one embodiment of the present invention. Mobile long-range artillery system 10 includes a tractor 12 and a trailer 14 connected to tractor 12. Trailer 14 receives an artillery assembly or gun assembly 16. In one example, tractor 12 includes a Heavy Expanded Mobility Tactical Truck (HEMTT) tractor, such as a M983 HEMTT tractor, as known in the art. Tractor 12 includes a chassis frame 20. Chassis frame 20 operatively connects to and rests over wheels 22. Tractor 12 encompasses a cabin 24 at the front. Cabin 24 includes seating and communications equipment (not shown) used for operating tractor 12. Tractor 12 includes an engine housing 26 at the back of cabin 24. Engine housing 26 includes a diesel engine or electric motor(s) for powering tractor 12. Further, tractor 12 encompasses a transmission 28 for transmitting the power generated by the diesel engine or electric motor(s) for driving wheels 22. Optionally, tractor 12 encompasses a tank 30 for storing fuel required to power the diesel engine. Further, chassis frame 20 includes a tractor hitch or truck bed hitch or fifth wheel hitch 32.

In the present invention, tractor 12 acts as a towing vehicle, and tows trailer 14 using tractor hitch 32. In one example, tractor hitch 32 presents a U-shaped coupling device positioned at the back of tractor 12 for towing trailer 14. Trailer or semitrailer 14 includes a trailer frame 40. In one example, trailer 14 includes a M870 40-ton trailer, as known in the art. Trailer frame 40 has a lowbed when compared to chassis frame 20. Trailer frame 40 operatively connects to wheels 42. Trailer 14 includes a gooseneck section 44 extending from trailer frame 40, at one end and receives artillery assembly 16 at the other end. In one implementation, gooseneck section 44 is configured to fold down for ease of equipment loading. Gooseneck section 44 includes a hitch ball 46. Hitch ball 46 connects to tractor hitch 32 and helps to tow trailer 14 by tractor 12.

Figure 2:
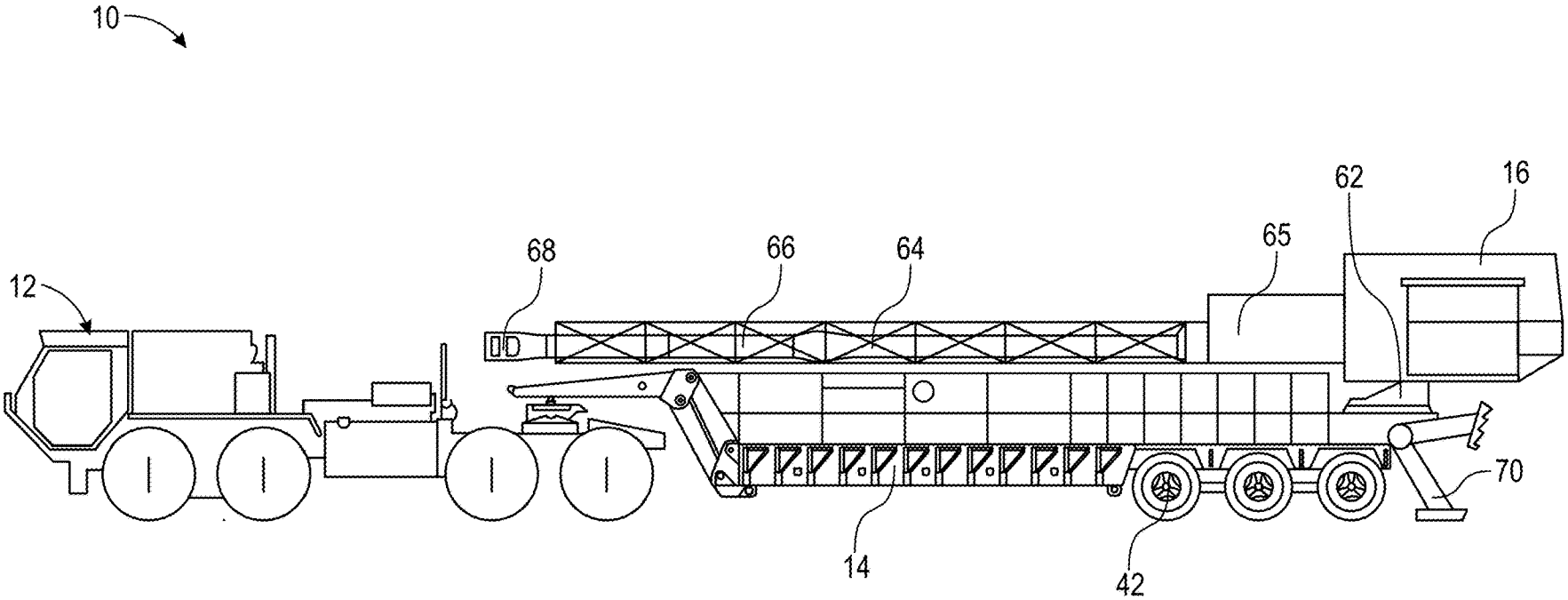
FIG. 2 is a side view of the mobile long-range artillery system in a retracted travel position (unused position), in accordance with one embodiment of the present invention.

Artillery assembly 16 includes an ammunition container/autoloader 60. Ammunition container 60 mounts over trailer frame 40 via a carriage 62. In one implementation, ammunition container 60 includes a 20-round autoloader and is configured to fire 8 rounds per minute. Artillery assembly 16 includes a cannon 65 having a cannon tube 64. Further, artillery assembly 16 includes a barrel 66 extending from cannon tube 64. Barrel 66 encompasses a muzzle brake 68, at the end as can be seen from FIG. 1. Barrel 66 is configured as a telescoping barrel that extends in length when artillery assembly 16 is in the deployed position as shown in FIG. 1 and retracts or reduces in length when in the stowed position as shown in FIG. 2. This telescoping configuration enables barrel 66 to achieve maximum length for optimal firing range during operations while maintaining a compact profile during transport. Further, artillery assembly 16 includes trails 70 at the bottom. Trails 70 include two or more trails 70 that are configured to extend outward from the artillery assembly 16 and engage the ground surface when artillery assembly 16 is unlimbered to provide enhanced stability during firing operations. Each trail 70 includes a ground-engaging foot or pad at its distal end that makes direct contact with the ground to distribute the load and absorb recoil forces generated during artillery discharge. In some examples, trails 70 are collapsible with leveling jacks that can be adjusted to ensure proper ground engagement and level positioning of artillery assembly 16 on uneven terrain. Trails 70 are pivotally connected to the artillery assembly 16 and can be deployed from a stowed position during transport to an extended position during firing operations. Trails 70 provide stability by creating a stable triangular base configuration, enable high-angle fire capability, and allow 360° traverse for operating artillery assembly 16.

Figure 3:
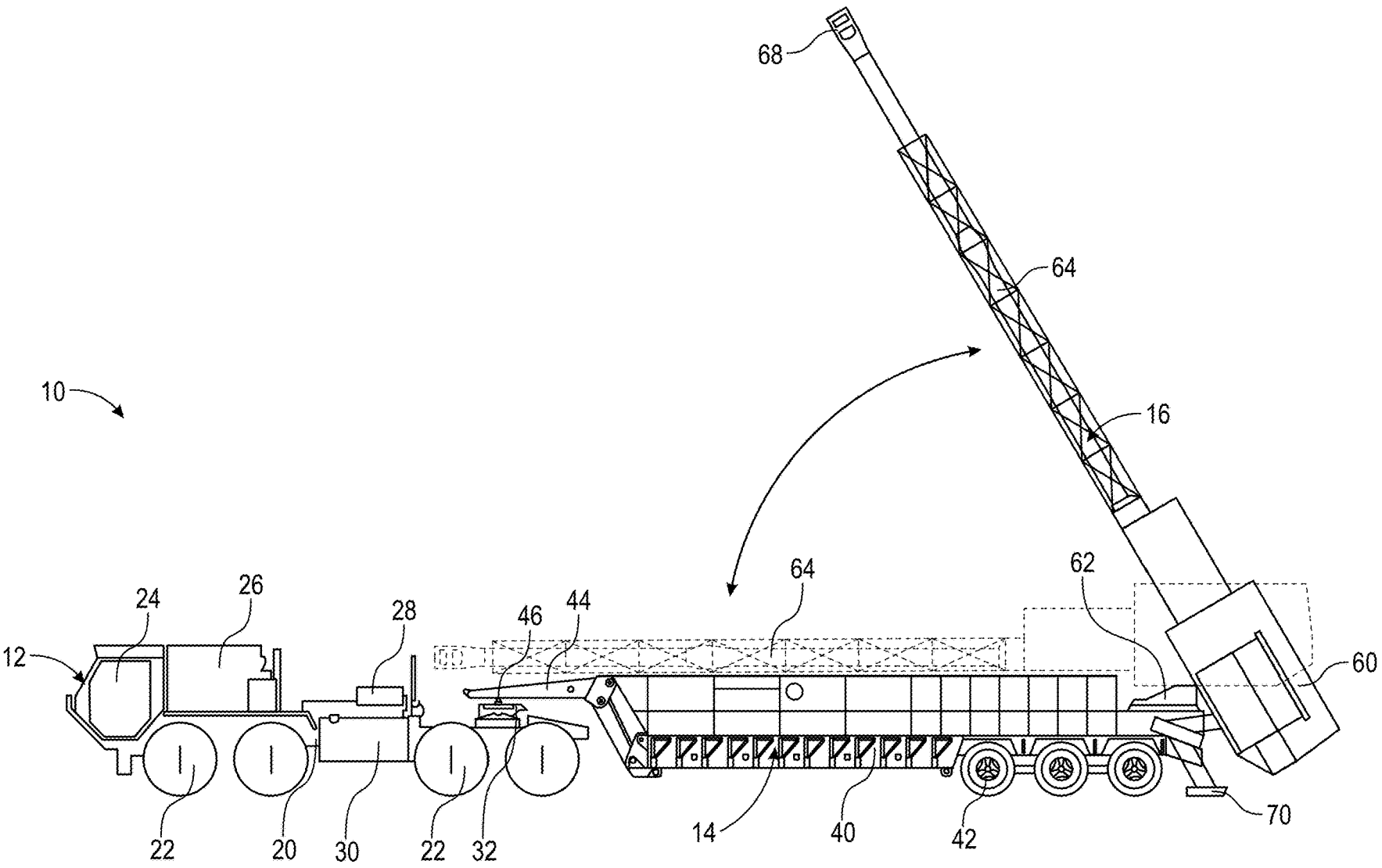
FIG. 3 shows tilting/positioning of the mobile long-range artillery system from the retracted travel position to the deployed position, in accordance with one embodiment of the present invention.

In the present invention, cannon 65 includes a 88 caliber 155 millimeter (mm) cannon capable of firing ammunition up to 96 kilometers. The 88 caliber 155 mm cannon with 20 round autoloader is mounted on standard trailer 14 towed by HEMTT tractor 12 such that mobile long-range artillery system 10 becomes a long range road mobile artillery vehicle. FIG. 2 shows a feature of mobile long-range artillery system 10 in a retracted travel position/unused position. Here, artillery assembly 16 is positioned horizontally with respect to trailer 14. Barrel 66 slidably mounts to ammunition container 60 in such a way that it is deployable from the retracted travel position (FIG. 2) to a run-out position/deployed position (FIG. 3). Barrel 66 slidably mounts to ammunition container 60 and includes telescoping sections that enable barrel 66 to extend in length when deployed from the retracted travel position (FIG. 2) to the run-out position/deployed position (FIG. 3). In the retracted travel position shown in FIG. 2, barrel 66 is in a reduced length configuration, while in the extended position shown in FIG. 3, barrel 66 extends to its full operational length to maximize firing range. FIG. 3 shows the feature of raising artillery assembly 16 at an angle with respect to trailer 14 in order to launch/fire ammunition. As specified above, ammunition container 60 is configured to store 20 shells and is movably attached to trailer 14 via turntable carriage 62. Carriage 62 allows artillery assembly 16 to rotate up to 75 degrees and pivot up to 70 degrees for elevation adjustment, as shown in FIG. 3, for example. The rotational capability of up to 75 degrees enables the artillery assembly 16 to traverse and target different azimuth angles for precise targeting operations, while the pivoting capability of up to 70 degrees allows for precise elevation control to achieve the desired firing trajectory for long-range artillery operations. This combination of rotational movement and pivoting capability provided by carriage 62 enables comprehensive targeting operations by allowing artillery assembly 16 to be positioned and oriented to engage targets across a wide range of positions and distances.

The presently disclosed mobile long-range artillery system 10 is configured to fire 8 rounds of ammunition per minute. Consider a scenario of having four battery of artillery assemblies 16, each capable of firing 8 rounds per minute. In such a scenario, four cannons 65 can be configured to fire up to 80 rounds of ammunition at 96 km in 2 minutes 30 seconds, before they can be redeployed. In other words, a single gun/artillery assembly 16 fires 8 rounds in a minute, i.e., with four cannons/guns 16 (8+8+4=20) rounds can be fired in 2½ minutes, and 80 (20*4=80) rounds can be fired by 4 cannons/guns in 2½ minutes. When the autoloader fires 8 rounds per minute, a battery of 4 guns drop 80 rounds at 96 km in 2½ minutes and then redeploy.

In some aspects, the 20-round autoloader may be configured to discharge its entire ammunition load in approximately 2½ minutes. This timing capability may be achieved through the autoloader's rapid-fire mechanism that maintains a consistent firing rate of 8 rounds per minute throughout the complete firing sequence. The autoloader may include automated loading mechanisms that sequentially position each round for firing without manual intervention, allowing for continuous operation until the ammunition supply is depleted. In some cases, the timing may vary slightly based on operational conditions, ammunition type, and system maintenance status, but the autoloader may consistently deliver the full 20-round capacity within the specified timeframe. This rapid deployment capability may enable the mobile long-range artillery system to deliver concentrated firepower and then quickly relocate to avoid counter-battery fire, enhancing tactical mobility and survivability in combat operations.

Although the present invention is explained considering that mobile long-range artillery system 10 has 88 caliber 155 mm cannon, it is possible to modify mobile long-range artillery system 10 i.e., modify trailer 14 and artillery assembly 16 to accommodate 203 mm 67-caliber cannon or 240 mm 57-caliber cannon for ultra-long range (longer than 96 kms) cannon shells/ammunition.

Figure 4:
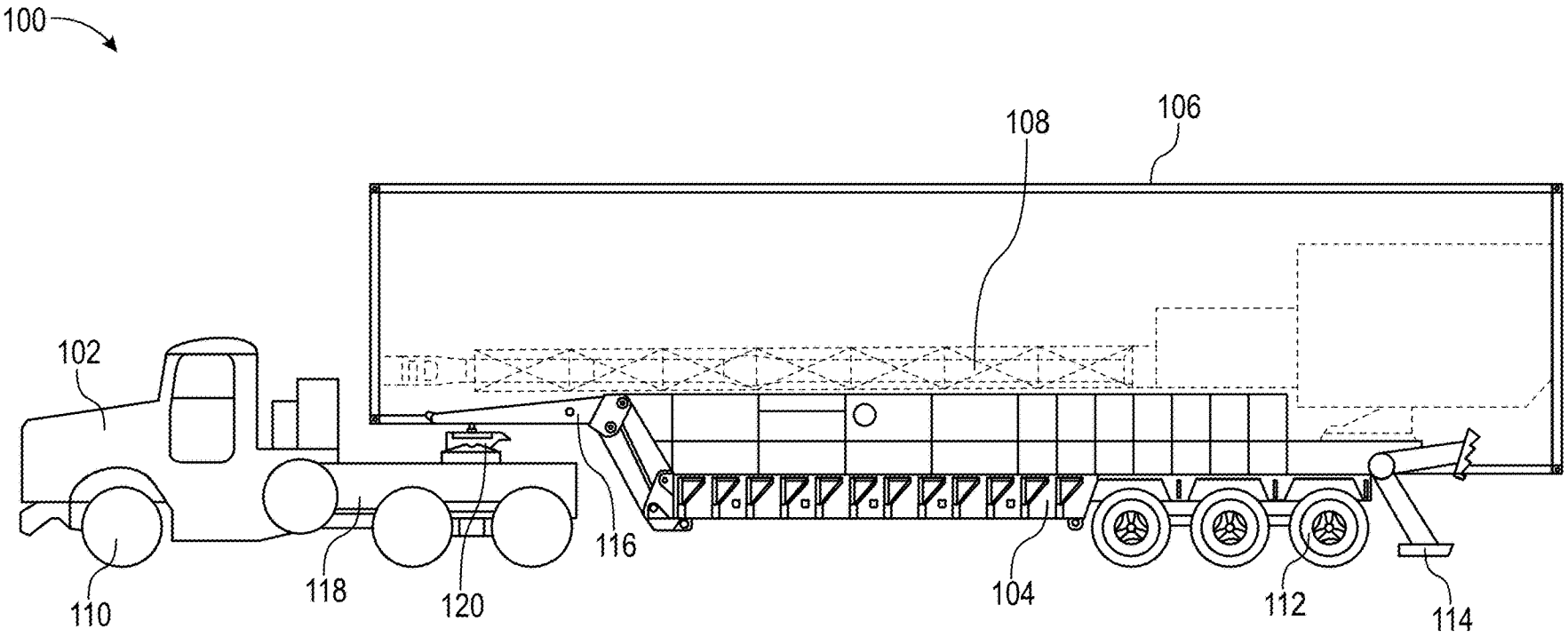
FIG. 4 shows a side view of a mobile long-range artillery system in a travelling configuration, in accordance with another embodiment of the present invention.

FIG. 4 shows a side view of a mobile long-range artillery system 100 in a travelling position, in accordance with one embodiment of the present invention. Mobile long-range artillery system 100 includes a tractor or truck 102 and a trailer 104 connected to truck 102. Trailer 104 encompasses a container 106. Container 106 comes in a rectangular configuration and extends along the entire length of container 106. In the present embodiment, container 106 encompasses an artillery assembly or gun assembly 108. Here, truck 102 comes in the shape of a regular truck and container 106 comes in the shape of a shipping container with standardized dimensions, external markings, and visual characteristics that mimic conventional cargo containers used in commercial transportation. Container 106 includes exterior surfaces configured with standard shipping container features including corner castings, corrugated side panels, and identification markings that provide visual deception to observers. Container 106 is specifically dimensioned and configured to conceal the internal artillery assembly 108 while maintaining the external appearance of a standard commercial shipping container, such that artillery assembly 108 is effectively camouflaged within container 106. In the traveling position shown in FIG. 4, the barrel of artillery assembly 108 is in a stowed position with reduced length, similar to the retracted configuration shown in FIG. 2, enabling artillery assembly 108 to fit within the dimensions of container 106 during transport.

Truck 102 includes truck wheels 110, and trailer 104 includes trailer wheels 112 for maneuvering truck 102 and trailer 104, respectively. Furthermore, mobile long-range artillery system 100 includes trails 114 at the rear. Trails 114 include two or more trails 114 that are spread/rest on the ground when artillery assembly 108 is unlimbered to provide more stability during the operation of artillery assembly 108. Trails 114 provide stability, high-angle fire, and 360° traverse for operating artillery assembly 108. Further, trailer 104 presents a gooseneck section 116 that connects to a truck hitch 120 positioned on the chassis of truck 102.

The present embodiment is presented to show truck 102 and container 106 appearing as a traditional semi-trailer truck with cargo container while camouflaging artillery assembly 108 placed in container 106.

The mobile long-range artillery system may be deployed in various military and defense applications where extended range capabilities and tactical mobility are advantageous. In some aspects, the mobile long-range artillery system may be utilized in conventional warfare scenarios where rapid artillery support is required across extended battlefields, enabling forces to engage targets at distances up to 96 kilometers while maintaining the ability to quickly reposition to avoid counter-battery fire. The mobile long-range artillery system may also find application in border defense operations, where the combination of long-range capability and mobility allows for flexible positioning along extended frontier areas.

In some cases, the mobile long-range artillery system may be employed in expeditionary operations where traditional fixed artillery installations are not feasible or practical. The trailer-mounted configuration may enable deployment in remote or austere environments where the mobility provided by the HEMTT tractor allows access to otherwise inaccessible firing positions. The mobile long-range artillery system may also be suitable for rapid response scenarios where artillery support must be quickly deployed to emerging threat areas.

The camouflaged embodiment shown in FIG. 4 may be used in covert operations or situations where concealment of military assets is advantageous. The container configuration may allow the artillery assembly to be transported through civilian areas or positioned in locations where a standard military vehicle might attract unwanted attention. Additionally, the mobile long-range artillery system may be employed in training exercises and military demonstrations where the combination of mobility and firepower can be effectively showcased.

The presently disclosed mobile long-range artillery system provides several advantages over prior art. The mobile long-range artillery system offers a wheeled self-propelled artillery system comprising a prime mover/tractor possessing the primary source of power a trailer and a gun assembly/artillery system movably attached to the trailer. The mobile long-range artillery system integrates heavy-duty tractor and trailer enabling mobility and allowing the artillery assembly to be transported over long distances. The mobile long-range artillery system has long range firepower with a 88-caliber 155 mm cannon, having a 96-kilometer range. In addition, the mobile long-range artillery system integrates the autoloader with a rapid firing capacity before the ammunition can be redeployed.

A person skilled in the art appreciates that the mobile long-range artillery system can come in a variety of shapes and sizes depending on the need and comfort of the user. Further, many changes in the design and placement of components may take place without deviating from the scope of the presently disclosed mobile long-range artillery system.

In the above description, numerous specific details are set forth such as examples of some embodiments, specific components, devices, methods, in order to provide a thorough understanding of embodiments of the present invention. It will be apparent to a person of ordinary skill in the art that these specific details need not be employed, and should not be construed to limit the scope of the invention.

In the development of any actual implementation, numerous implementation-specific decisions must be made to achieve the developer's specific goals, such as compliance with system-related and business-related constraints. Such a development effort might be complex and time-consuming, but may nevertheless be a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

The foregoing description of embodiments is provided to enable any person skilled in the art to make and use the invention. Various modifications to these embodiments will be readily apparent to those skilled in the art, and the novel principles and invention disclosed herein may be applied to other embodiments without the use of the innovative faculty. It is contemplated that additional embodiments are within the spirit and true scope of the disclosed invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A mobile long-range artillery system, comprising:

a tractor having a chassis frame and a tractor hitch;

a trailer connected to said tractor via said tractor hitch;

an artillery assembly mounted on said trailer, said artillery assembly comprising an ammunition container configured as a 20-round autoloader capable of firing 8 rounds per minute;

a carriage supporting said ammunition container on said trailer;

an 88-caliber 155 mm cannon having a cannon tube extending from said ammunition container and capable of firing ammunition up to 96 kilometers;

a barrel extending from said cannon tube and deployable from a retracted travel position to a run-out firing position; and trails configured to engage the ground to provide stability during firing operations.

2. The mobile long-range artillery system of claim 1, wherein said tractor comprises a Heavy Expanded Mobility Tactical Truck (HEMTT) tractor.

3. The mobile long-range artillery system of claim 1, wherein said trailer comprises a M870 40-ton trailer.

4. The mobile long-range artillery system of claim 1, wherein said 20-round autoloader is configured to fire an entire load in 2½ minutes.

5. The mobile long-range artillery system of claim 1, wherein said carriage comprises a turntable providing rotational movement and pivoting capability for said artillery assembly.

6. The mobile long-range artillery system of claim 5, wherein said carriage allows said artillery assembly to rotate up to 75 degrees and pivot up to 70 degrees for elevation adjustment.

7. The mobile long-range artillery system of claim 1, wherein said barrel comprises a muzzle brake at a distal end thereof.

8. The mobile long-range artillery system of claim 1, wherein said artillery assembly is deployable from a mobility mode in which said artillery assembly is free of direct contact with the ground to a firing mode in which said trails engage the ground.

9. The mobile long-range artillery system of claim 1, wherein said trailer is configurable to accommodate larger caliber cannons for ultra-long-range capabilities exceeding 96 kilometers.

10. The mobile long-range artillery system of claim 9, wherein said larger caliber cannons comprise 203 mm or 240 mm cannons.

11. A mobile long-range artillery system, comprising:

a tractor having a chassis frame supported by wheels and including a cabin, an engine housing, and a tractor hitch;

a trailer connected to said tractor via said tractor hitch, said trailer having a trailer frame supported by wheels;

a container mounted on said trailer and configured to camouflage an artillery assembly positioned within said container, said artillery assembly comprising an ammunition container configured as a 20-round autoloader capable of firing 8 rounds per minute;

a carriage providing rotational movement and pivoting capability to said artillery assembly;

an 88-caliber 155 mm cannon comprising a cannon tube and capable of firing ammunition up to 96 kilometers;

a barrel extending from said cannon tube and deployable from said container for firing operations; and and trails deployable from said trailer to provide ground engagement during firing operations.

12. The mobile long-range artillery system of claim 11, wherein said container has a rectangular configuration resembling a shipping container.

13. The mobile long-range artillery system of claim 11, wherein said tractor comprises a Heavy Expanded Mobility Tactical Truck (HEMTT) tractor and said trailer comprises a 40-ton trailer.

14. The mobile long-range artillery system of claim 11, wherein said mobile long-range artillery system presents an appearance of a traditional semi-trailer truck with cargo container during transport.

15. The mobile long-range artillery system of claim 11, wherein said carriage allows said artillery assembly to rotate up to 75 degrees and pivot up to 70 degrees for elevation adjustment.

16. The mobile long-range artillery system of claim 11, wherein said 20-round autoloader is configured to fire an entire load in 2½ minutes.

17. The mobile long-range artillery system of claim 11, wherein said artillery assembly includes a muzzle brake positioned at a distal end of said cannon barrel and configured to reduce recoil forces during firing operations.

18. The mobile long-range artillery system of claim 11, wherein said artillery assembly is deployable from a mobility mode in which said artillery assembly is free of direct contact with the ground to a firing mode in which said trails engage the ground.

19. The mobile long-range artillery system of claim 11, wherein said trailer is configurable to accommodate larger caliber cannons for ultra-long-range capabilities exceeding 96 kilometers.

20. The mobile long-range artillery system of claim 19, wherein said larger caliber cannons comprise 203 mm or 240 mm cannons.

* * * * *